US009779716B2

(12) United States Patent
Gadonniex et al.

(10) Patent No.: US 9,779,716 B2
(45) Date of Patent: Oct. 3, 2017

(54) OCCLUSION REDUCTION AND ACTIVE NOISE REDUCTION BASED ON SEAL QUALITY

(71) Applicant: Knowles Electronics, LLC, Itasca, IL (US)

(72) Inventors: Sharon Gadonniex, Arlington, MA (US); John Woodruff, Palo Alto, CA (US); Tony Verma, San Francisco, CA (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 14/985,057

(22) Filed: Dec. 30, 2015

(65) Prior Publication Data

US 2017/0193974 A1 Jul. 6, 2017

(51) Int. Cl.
*H04R 1/10* (2006.01)
*G10K 11/178* (2006.01)
(Continued)

(52) U.S. Cl.
CPC ..... *G10K 11/178* (2013.01); *G10L 25/81* (2013.01); *H04R 1/1016* (2013.01);
(Continued)

(58) Field of Classification Search
CPC ..... G10K 11/178; G10K 11/1782; G10K 11/1784; G10K 11/1786;
(Continued)

(56) References Cited

U.S. PATENT DOCUMENTS 2,535,063 A 12/1950 Halstead
3,995,113 A 11/1976 Tani
(Continued)

FOREIGN PATENT DOCUMENTS

CN 204119490 U 1/2015
CN 204145685 U 2/2015
(Continued)

OTHER PUBLICATIONS

Hegde, Nagaraj, "Seamlessly Interfacing MEMS Microphones with BlackfinTM Processors", EE350 Analog Devices, Rev. 1, Aug. 2010, pp. 1-10.
(Continued)

*Primary Examiner* — Mark Fischer
(74) *Attorney, Agent, or Firm* — Foley & Lardner LLP

(57) ABSTRACT

Systems and methods for active noise reduction and occlusion reduction based on seal quality of an in-the-ear (ITE) module inserted into a user's ear canal are provided. An example method includes receiving one or more acoustic signals. Each of the acoustic signals represents at least one captured sound having at least one of a voice component and an unwanted noise. The voice component may include the user's own voice. A quality of a seal of an ear canal is determined based at least partially on the acoustic signals. If the quality of the seal exceeds a predetermined threshold value, an occlusion reduction is performed on the acoustic signals to improve the voice component. If the quality of the seal is below a predetermined threshold value, active noise reduction is performed on the acoustic signals to reduce the unwanted noise.

21 Claims, 5 Drawing Sheets

(51) Int. Cl.
*G10L 25/81* (2013.01)
*H04R 3/00* (2006.01)

(52) U.S. Cl.
CPC ..... *H04R 1/1041* (2013.01); *H04R 3/00* (2013.01); *H04R 2460/01* (2013.01); *H04R 2460/05* (2013.01); *H04R 2460/11* (2013.01); *H04R 2460/15* (2013.01)

(58) Field of Classification Search
CPC . G10K 2210/1081; G10L 25/81; G10L 25/84; H04R 1/1016; H04R 1/1041; H04R 3/00; H04R 2460/01; H04R 2460/05; H04R 2460/11; H04R 2460/15
See application file for complete search history.

(56) References Cited

U.S. PATENT DOCUMENTS 4,150,262 A 4/1979 Ono
4,455,675 A 6/1984 Bose et al.
4,516,428 A 5/1985 Konomi
4,520,238 A 5/1985 Ikeda
4,588,867 A 5/1986 Konomi
4,596,903 A 6/1986 Yoshizawa
4,644,581 A 2/1987 Sapiejewski
4,652,702 A 3/1987 Yoshii
4,696,045 A 9/1987 Rosenthal
4,975,967 A 12/1990 Rasmussen
5,208,867 A 5/1993 Stites, III
5,222,050 A 6/1993 Marren et al.
5,251,263 A 10/1993 Andrea et al.
5,282,253 A 1/1994 Konomi
5,289,273 A 2/1994 Lang
5,295,193 A 3/1994 Ono
5,305,387 A 4/1994 Sapiejewski
5,319,717 A 6/1994 Holesha
5,327,506 A 7/1994 Stites, III
D360,691 S 7/1995 Mostardo
D360,948 S 8/1995 Mostardo
D360,949 S 8/1995 Mostardo
5,490,220 A 2/1996 Loeppert
5,734,621 A 3/1998 Ito
5,870,482 A 2/1999 Loeppert et al.
D414,493 S 9/1999 Jiann-Yeong
5,960,093 A 9/1999 Miller
5,983,073 A 11/1999 Ditzik
6,044,279 A 3/2000 Hokao et al.
6,061,456 A 5/2000 Andrea et al.
6,094,492 A 7/2000 Boesen
6,118,878 A 9/2000 Jones
6,122,388 A 9/2000 Feldman
6,130,953 A 10/2000 Wilton et al.
6,184,652 B1 2/2001 Yang
6,211,649 B1 4/2001 Matsuda
6,219,408 B1 4/2001 Kurth
6,255,800 B1 7/2001 Bork
D451,089 S 11/2001 Hohl et al.
6,362,610 B1 3/2002 Yang
6,373,942 B1 4/2002 Braund
6,408,081 B1 6/2002 Boesen
6,462,668 B1 10/2002 Foseide
6,535,460 B2 3/2003 Loeppert et al.
6,567,524 B1 5/2003 Svean et al.
6,661,901 B1 12/2003 Svean et al.
6,683,965 B1 1/2004 Sapiejewski
6,694,180 B1 2/2004 Boesen
6,717,537 B1 4/2004 Fang et al.
6,738,485 B1 5/2004 Boesen
6,748,095 B1 6/2004 Goss
6,751,326 B2 6/2004 Nepomuceno
6,754,358 B1 6/2004 Boesen et al.
6,754,359 B1 6/2004 Svean et al.
6,757,395 B1 6/2004 Fang et al.
6,801,632 B2 10/2004 Olson
6,847,090 B2 1/2005 Loeppert
6,879,698 B2 4/2005 Boesen
6,920,229 B2 7/2005 Boesen
6,931,292 B1 8/2005 Brumitt et al.
6,937,738 B2 8/2005 Armstrong et al.
6,987,859 B2 1/2006 Loeppert et al.
7,023,066 B2 4/2006 Lee et al.
7,024,010 B2 4/2006 Saunders et al.
7,039,195 B1 5/2006 Svean et al.
7,103,188 B1 9/2006 Jones
7,132,307 B2 11/2006 Wang et al.
7,136,500 B2 11/2006 Collins
7,203,331 B2 4/2007 Boesen
7,209,569 B2 4/2007 Boesen
7,215,790 B2 5/2007 Boesen et al.
7,289,636 B2 10/2007 Saunders et al.
7,302,074 B2 11/2007 Wagner et al.
D573,588 S 7/2008 Warren et al.
7,406,179 B2 7/2008 Ryan
7,433,481 B2 10/2008 Armstrong et al.
7,477,754 B2 1/2009 Rasmussen et al.
7,477,756 B2 1/2009 Wickstrom et al.
7,502,484 B2 3/2009 Ngia et al.
7,590,254 B2 9/2009 Olsen
7,680,292 B2 3/2010 Warren et al.
7,747,032 B2 6/2010 Zei et al.
7,773,759 B2 8/2010 Alves et al.
7,869,610 B2 1/2011 Jayanth et al.
7,889,881 B2 2/2011 Ostrowski
7,899,194 B2 3/2011 Boesen
7,965,834 B2 6/2011 Alves et al.
7,983,433 B2 7/2011 Nemirovski
8,005,249 B2 8/2011 Wirola et al.
8,019,107 B2 9/2011 Ngia et al.
8,027,481 B2 9/2011 Beard
8,045,724 B2 10/2011 Sibbald
8,072,010 B2 12/2011 Lutz
8,077,873 B2 12/2011 Shridhar et al.
8,081,780 B2 12/2011 Goldstein et al.
8,103,029 B2 1/2012 Ngia et al.
8,111,853 B2 2/2012 Isvan
8,116,489 B2 2/2012 Mejia et al.
8,116,502 B2 2/2012 Saggio, Jr. et al.
8,135,140 B2 3/2012 Shridhar et al.
8,180,067 B2 5/2012 Soulodre
8,189,799 B2 5/2012 Shridhar et al.
8,194,880 B2 6/2012 Avendano
8,199,924 B2 6/2012 Wertz et al.
8,213,643 B2 7/2012 Hemer
8,213,645 B2 7/2012 Rye et al.
8,229,125 B2 7/2012 Short
8,229,740 B2 7/2012 Nordholm et al.
8,238,567 B2 8/2012 Burge et al.
8,249,287 B2 8/2012 Silvestri et al.
8,254,591 B2 8/2012 Goldstein et al.
8,270,626 B2 9/2012 Shridhar et al.
8,285,344 B2 10/2012 Kahn et al.
8,295,503 B2 10/2012 Sung et al.
8,311,253 B2 11/2012 Silvestri et al.
8,315,404 B2 11/2012 Shridhar et al.
8,325,963 B2 12/2012 Kimura
8,331,604 B2 12/2012 Saito et al.
8,363,823 B1 1/2013 Santos
8,376,967 B2 2/2013 Mersky
8,385,560 B2 2/2013 Solbeck et al.
8,401,200 B2 3/2013 Tiscareno et al.
8,401,215 B2 3/2013 Warren et al.
8,416,979 B2 4/2013 Takai
8,462,956 B2 6/2013 Goldstein et al.
8,473,287 B2 6/2013 Every et al.
8,483,418 B2 7/2013 Platz et al.
8,488,831 B2 7/2013 Saggio, Jr. et al.
8,494,201 B2 7/2013 Anderson
8,498,428 B2 7/2013 Schreuder et al.
8,503,689 B2 8/2013 Schreuder et al.
8,503,704 B2 8/2013 Francart et al.
8,509,465 B2 8/2013 Theverapperuma
8,526,646 B2 9/2013 Boesen
8,532,323 B2 9/2013 Wickstrom et al.
8,553,899 B2 10/2013 Salvetti et al.

(56) References Cited

U.S. PATENT DOCUMENTS 8,553,923 B2 10/2013 Tiscareno et al.
8,571,227 B2 10/2013 Donaldson et al.
8,594,353 B2 11/2013 Anderson
8,620,650 B2 12/2013 Walters et al.
8,634,576 B2 1/2014 Salvetti et al.
8,655,003 B2 2/2014 Duisters et al.
8,666,102 B2 3/2014 Bruckhoff et al.
8,681,999 B2 3/2014 Theverapperuma et al.
8,682,001 B2 3/2014 Annunziato et al.
8,705,787 B2 4/2014 Larsen et al.
8,837,746 B2 9/2014 Burnett
8,942,976 B2 1/2015 Li et al.
8,983,083 B2 3/2015 Tiscareno et al.
9,014,382 B2 4/2015 Van De Par et al.
9,025,415 B2 5/2015 Derkx
9,042,588 B2 5/2015 Aase
9,047,855 B2 6/2015 Bakalos
9,078,064 B2 7/2015 Wickstrom et al.
9,100,756 B2 8/2015 Dusan et al.
9,107,008 B2 8/2015 Leitner
9,123,320 B2 9/2015 Carreras et al.
9,154,868 B2 10/2015 Narayan et al.
9,167,337 B2 10/2015 Shin
9,185,487 B2 11/2015 Solbach et al.
9,208,769 B2 12/2015 Azmi
9,226,068 B2 12/2015 Hendrix et al.
9,264,823 B2 2/2016 Bajic et al.
2001/0011026 A1 8/2001 Nishijima
2001/0021659 A1 9/2001 Okamura
2001/0049262 A1 12/2001 Lehtonen
2002/0016188 A1 2/2002 Kashiwamura
2002/0021800 A1 2/2002 Bodley et al.
2002/0038394 A1 3/2002 Liang et al.
2002/0054684 A1 5/2002 Menzl
2002/0056114 A1 5/2002 Fillebrown et al.
2002/0067825 A1 6/2002 Baranowski et al.
2002/0098877 A1 7/2002 Glezerman
2002/0136420 A1 9/2002 Topholm
2002/0159023 A1 10/2002 Swab
2002/0176330 A1 11/2002 Ramonowski et al.
2002/0183089 A1 12/2002 Heller et al.
2003/0002704 A1 1/2003 Pronk
2003/0013411 A1 1/2003 Uchiyama
2003/0017805 A1 1/2003 Yeung et al.
2003/0058808 A1 3/2003 Eaton et al.
2003/0085070 A1 5/2003 Wickstrom
2003/0207703 A1 11/2003 Liou et al.
2003/0223592 A1 12/2003 Deruginsky et al.
2005/0027522 A1 2/2005 Yamamoto et al.
2005/0058313 A1* 3/2005 Victorian ..... H04R 25/554 381/315
2006/0029234 A1 2/2006 Sargaison
2006/0034472 A1 2/2006 Bazarjani et al.
2006/0153155 A1 7/2006 Jacobsen et al.
2006/0227990 A1 10/2006 Kirchhoefer
2006/0239472 A1 10/2006 Oda
2007/0104340 A1 5/2007 Miller et al.
2007/0147635 A1 6/2007 Dijkstra et al.
2008/0019548 A1 1/2008 Avendano
2008/0063228 A1 3/2008 Mejia et al.
2008/0101640 A1 5/2008 Ballad et al.
2008/0107287 A1* 5/2008 Beard ..... H04R 1/1016 381/111
2008/0181419 A1 7/2008 Goldstein et al.
2008/0232621 A1 9/2008 Burns
2009/0041269 A1 2/2009 Hemer
2009/0080670 A1 3/2009 Solbeck et al.
2009/0182913 A1 7/2009 Rosenblatt et al.
2009/0207703 A1 8/2009 Matsumoto et al.
2009/0214068 A1 8/2009 Wickstrom
2009/0323982 A1 12/2009 Solbach et al.
2010/0022280 A1 1/2010 Schrage
2010/0081487 A1 4/2010 Chen et al.
2010/0183167 A1 7/2010 Phelps et al.
2010/0233996 A1 9/2010 Herz et al.
2010/0270631 A1 10/2010 Renner
2011/0116643 A1 5/2011 Tiscareno et al.
2011/0257967 A1 10/2011 Every et al.
2012/0008808 A1 1/2012 Saltykov
2012/0056282 A1 3/2012 Van Lippen et al.
2012/0099753 A1 4/2012 van der Avoort et al.
2012/0197638 A1 8/2012 Li et al.
2012/0321103 A1 12/2012 Smailagic et al.
2013/0024194 A1 1/2013 Zhao et al.
2013/0051580 A1 2/2013 Miller
2013/0058495 A1 3/2013 Furst et al.
2013/0070935 A1 3/2013 Hui et al.
2013/0142358 A1 6/2013 Schultz et al.
2013/0272564 A1 10/2013 Miller
2013/0287219 A1 10/2013 Hendrix et al.
2013/0315415 A1 11/2013 Shin
2013/0322642 A1 12/2013 Streitenberger et al.
2013/0343580 A1 12/2013 Lautenschlager et al.
2013/0345842 A1 12/2013 Karakaya et al.
2014/0010378 A1 1/2014 Voix et al.
2014/0044275 A1 2/2014 Goldstein et al.
2014/0086425 A1 3/2014 Jensen et al.
2014/0169579 A1 6/2014 Azmi
2014/0233741 A1 8/2014 Gustavsson
2014/0247948 A1 9/2014 Goldstein
2014/0270231 A1 9/2014 Dusan et al.
2014/0273851 A1 9/2014 Donaldson et al.
2014/0348346 A1 11/2014 Fukuda
2014/0355787 A1 12/2014 Jiles et al.
2015/0025881 A1 1/2015 Carlos et al.
2015/0043741 A1 2/2015 Shin
2015/0055810 A1 2/2015 Shin
2015/0078574 A1 3/2015 Shin
2015/0110280 A1 4/2015 Wardle
2015/0161981 A1 6/2015 Kwatra
2015/0172814 A1 6/2015 Usher et al.
2015/0237448 A1 8/2015 Loeppert
2015/0243271 A1 8/2015 Goldstein
2015/0245129 A1 8/2015 Dusan et al.
2015/0264472 A1 9/2015 Aase
2015/0296305 A1 10/2015 Shao et al.
2015/0296306 A1 10/2015 Shao et al.
2015/0304770 A1 10/2015 Watson et al.
2015/0310846 A1 10/2015 Andersen et al.
2015/0325229 A1 11/2015 Carreras et al.
2015/0325251 A1 11/2015 Dusan et al.
2015/0365770 A1 12/2015 Lautenschlager
2015/0382094 A1 12/2015 Grinker et al.
2016/0007119 A1 1/2016 Harrington
2016/0021480 A1 1/2016 Johnson et al.
2016/0029345 A1 1/2016 Sebeni et al.
2016/0037261 A1 2/2016 Harrington
2016/0037263 A1 2/2016 Pal et al.
2016/0042666 A1 2/2016 Hughes
2016/0044151 A1 2/2016 Shoemaker et al.
2016/0044398 A1 2/2016 Siahaan et al.
2016/0044424 A1 2/2016 Dave et al.
2016/0060101 A1 3/2016 Loeppert
2016/0105748 A1 4/2016 Pal et al.
2016/0127829 A1* 5/2016 Ring ..... H04R 1/10 381/61
2016/0150335 A1 5/2016 Qutub et al.
2016/0165334 A1 6/2016 Grossman
2016/0165361 A1 6/2016 Miller et al.
2016/0255433 A1* 9/2016 Grinker ..... H04R 1/1016

FOREIGN PATENT DOCUMENTS

CN 204168483 U 2/2015
CN 204669605 U 9/2015
CN 204681587 U 9/2015
CN 204681593 U 9/2015
CN ZL2015203769650 9/2015
CN ZL2015204747042 9/2015
CN ZL2015204903074 9/2015
DE 915826 7/1954
DE 3723275 3/1988
DE 102009051713 5/2011
DE 102011003470 8/2012

(56) References Cited

FOREIGN PATENT DOCUMENTS

| | | | |
|---|---|---|---|
| EP | 0124870 | | 11/1984 |
| EP | 0500985 | | 9/1992 |
| EP | 0684750 | | 11/1995 |
| EP | 0806909 | | 11/1997 |
| EP | 1299988 | | 4/2003 |
| EP | 1509065 | | 2/2005 |
| EP | 1310136 | B1 | 3/2006 |
| EP | 1469701 | B1 | 4/2008 |
| EP | 2434780 | | 3/2012 |
| JP | S5888996 | A | 5/1983 |
| JP | S60103798 | | 6/1985 |
| JP | 2007150743 | A | 6/2007 |
| JP | 2012169828 | A | 9/2012 |
| JP | 5049312 | B2 | 10/2012 |
| KR | 20110058769 | A | 6/2011 |
| KR | 101194904 | B1 | 10/2012 |
| KR | 1020140026722 | A | 3/2014 |
| WO | WO8303733 | | 10/1983 |
| WO | WO9407342 | | 3/1994 |
| WO | WO9623443 | | 8/1996 |
| WO | WO0025551 | | 5/2000 |
| WO | WO0217835 | | 3/2002 |
| WO | WO0217836 | | 3/2002 |
| WO | WO0217837 | | 3/2002 |
| WO | WO0217838 | | 3/2002 |
| WO | WO0217839 | | 3/2002 |
| WO | WO03073790 | | 9/2003 |
| WO | WO2006114767 | A1 | 11/2006 |
| WO | WO2007073818 | | 7/2007 |
| WO | WO2007082579 | | 7/2007 |
| WO | WO2007147416 | | 12/2007 |
| WO | WO2008128173 | | 10/2008 |
| WO | WO2009012491 | | 1/2009 |
| WO | WO2009023784 | | 2/2009 |
| WO | WO2011051469 | | 5/2011 |
| WO | WO2011061483 | | 5/2011 |
| WO | WO-2012/093343 | A2 | 7/2012 |
| WO | WO2013033001 | A1 | 3/2013 |
| WO | WO2016085814 | A1 | 6/2016 |
| WO | WO2016089671 | A1 | 6/2016 |
| WO | WO2016089745 | A1 | 6/2016 |

OTHER PUBLICATIONS

Korean Office Action regarding Application No. 10-2014-7008553, dated May 21, 2015.

Written Opinion of the International Searching Authority and International Search Report mailed Jan. 21, 2013 in Patent Cooperation Treaty Application No. PCT/US2012/052478, filed Aug. 27, 2012.

Langberg, Mike, "Bluelooth Sharpens its Connections," Chicago Tribune, Apr. 29, 2002, Business Section, p. 3, accessed Mar. 11, 2016 at URL: <http://articles.chicagotribune.com/2002-04-29/business/0204290116_1_bluetooth-enabled-bluetooth-headset-bluetooth-devices>.

*Duplan Corporaton* vs. *Deering Milliken* decision, 197 USPQ 342.

Combined Bluetooth Headset and USB Dongle, Advance Information, RTX Telecom A/S, vol. 1, Apr. 6, 2002.

Ephraim, Y. et al., "Speech enhancement using a minimum mean-square error short-time spectral amplitude estimator," IEEE Transactions on Acoustics, Speech, and Signal Processing, vol. ASSP-32, No. 6, Dec. 1984, pp. 1109-1121.

Sun et al., "Robust Noise Estimation Using Minimum Correction with Harmonicity Control." Conference: INTERSPEECH 2010, 11th Annual Conference of the International Speech Communication Association, Makuhari, Chiba, Japan, Sep. 26-30, 2010. p. 1085-1088.

Lomas, "Apple Patents Earbuds With Noise-Canceling Sensor Smarts," Aug. 27, 2015. [retrieved on Sep. 16, 2015]. TechCrunch. Retrieved from the Internet: <URL: http://techcrunch.com/2015/08/27/apple-wireless-earbuds-at-last/>. 2 pages.

Smith, Gina, "New Apple Patent Applications: The Sound of Hearables to Come," aNewDomain, Feb. 12, 2016, accessed Mar. 2, 2016 at URL: <http://anewdomain.net/2016/02/12/new-apple-patent-applications-glimpse-hearables-come/>.

Qutub, Sarmad et al., "Acoustic Apparatus with Dual MEMS Devices," U.S. Appl. No. 14/872,887, filed Oct. 1, 2015.

Office Action dated Feb. 4, 2016 in U.S. Appl. No. 14/318,436, filed Jun. 27, 2014.

Office Action dated Jan. 22, 2016 in U.S. Appl. No. 14/774,666, filed Sep. 10, 2015.

International Search Report and Written Opinion for Patent Cooperation Treaty Application No. PCT/US2015/062940 dated Mar. 28, 2016 (10 pages).

International Search Report and Written Opinion for Patent Cooperation Treaty Application No. PCT/US2015/062393 dated Apr. 8, 2016 (9 pages).

International Search Report and Written Opinion for Patent Cooperation Treaty Application No. PCT/US2015/061871 dated Mar. 29, 2016 (9 pages).

Yen, Kuan-Chieh et al., "Microphone Signal Fusion", U.S. Appl. No. 14/853,947, filed Sep. 14, 2015.

Yen, Kuan-Chieh et al., "Audio Monitoring and Adaptation Using Headset Microphones Inside User's Ear Canal", U.S. Appl. No. 14/985,187, filed Dec. 30, 2015.

Miller, Thomas E. et al., "Voice-Enhanced Awareness Mode", U.S. Appl. No. 14/985,112, filed Dec. 30, 2015.

Verma, Tony, "Context Aware False Acceptance Rate Reduction", U.S. Appl. No. 14/749,425, filed Jun. 24, 2015.

International Search Report and Written Opinion, PCT/US2016/069020, Knowles Electronics, LLC, 10 pages (May 2, 2017).

* cited by examiner

OCCLUSION REDUCTION AND ACTIVE NOISE REDUCTION BASED ON SEAL QUALITY

FIELD

The present application relates generally to audio processing and, more specifically, to systems and methods for occlusion reduction and active noise cancellation based on seal quality.

BACKGROUND

An active noise reduction (ANR) system in an earpiece-based audio device can be used to reduce background noise. The ANR system can form a compensation signal adapted to cancel background noise at a listening position inside the earpiece. The compensation signal is provided to an audio transducer (e.g., a loudspeaker), which generates an "anti-noise" acoustic wave. The anti-noise acoustic wave is intended to attenuate or eliminate the background noise at the listening position via a destructive interference, so that only the desired audio remains. Consequently, a combination of the anti-noise acoustic wave and the background noise at the listening position results in cancellation of both and, hence, a reduction in noise.

An occlusion effect occurs when earpieces of a headset seal a person's (user's) ear canals. The person may hear uncomfortable sounds from their own voice caused by bone-conducted sound reverberating off the earpiece blocking the ear canal. The occlusion effect is more pronounced if the seal is very good. The occlusion effect can boost low frequency (usually below 500 Hz) sound pressure in the ear canal by 20 dB or more.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Methods and systems for occlusion reduction and ANR based on a determination of a quality of a seal are provided. The method may provide for more uniform performance of a headset across different seal qualities. An example method includes receiving acoustic signals. Each of the acoustic signals may represent at least one captured sound having at least one of a voice component and an unwanted noise, the voice component including the voice of a user. The example method further includes determining, based at least partially on the acoustic signals, a quality of a seal, provided by an in-the-ear module of a headset, of the user's ear canal. The example method switches between operational modes depending on seal quality. For example, if the quality of the seal is above a predetermined threshold value, the method may proceed with performing an occlusion reduction on the acoustic signals to improve the voice component. If the quality of the seal is below the predetermined threshold value, the method may proceed with performing an active noise reduction (ANR) on the acoustic signals to reduce the unwanted noise.

According to another example embodiment of the present disclosure, the steps of the method for occlusion reduction and the ANR based on a quality of a seal are stored on a non-transitory machine-readable medium comprising instructions, which, when implemented by one or more processors, perform the recited steps.

Other example embodiments of the disclosure and aspects will become apparent from the following description taken in conjunction with the following drawings.

BRIEF DESCRIPTION OF DRAWINGS

Embodiments are illustrated by way of example and not limitation in the figures of the accompanying drawings, in which like references indicate similar elements and in which.

DETAILED DESCRIPTION

The present technology provides systems and methods for occlusion reduction and ANR based on a determination of a quality of a seal, which can overcome or substantially alleviate problems associated with uncomfortable sounds in an ear canal. Embodiments of the present technology may be practiced on any earpiece-based audio device that is configured to receive and/or provide audio such as, but not limited to, cellular phones, MP3 players, phone handsets, hearing aids, and headsets. While some embodiments of the present technology are described in reference to operation of a cellular phone, the present technology may be practiced on any audio device.

According to an example embodiment, the method for occlusion reduction and ANR based on a determination of a quality of a seal includes receiving acoustic signals. The method may provide for more uniform performance of a headset across different seal qualities. For the example method, each of the acoustic signals represents at least one captured sound. The captured sound may include at least one of a voice component and an unwanted noise. The voice component may include the voice of a user.

The method further includes determining, based at least partially on the acoustic signals, at least the quality of a seal of an ear canal. If the quality of the seal is above a predetermined threshold value, the example method proceeds with performing an occlusion reduction on the acoustic signals in order to improve the voice component. Alternatively, if the quality of the seal is below the predetermined threshold value, the example method proceeds with performing an ANR on the acoustic signals to reduce the unwanted noise.

Figure 1:
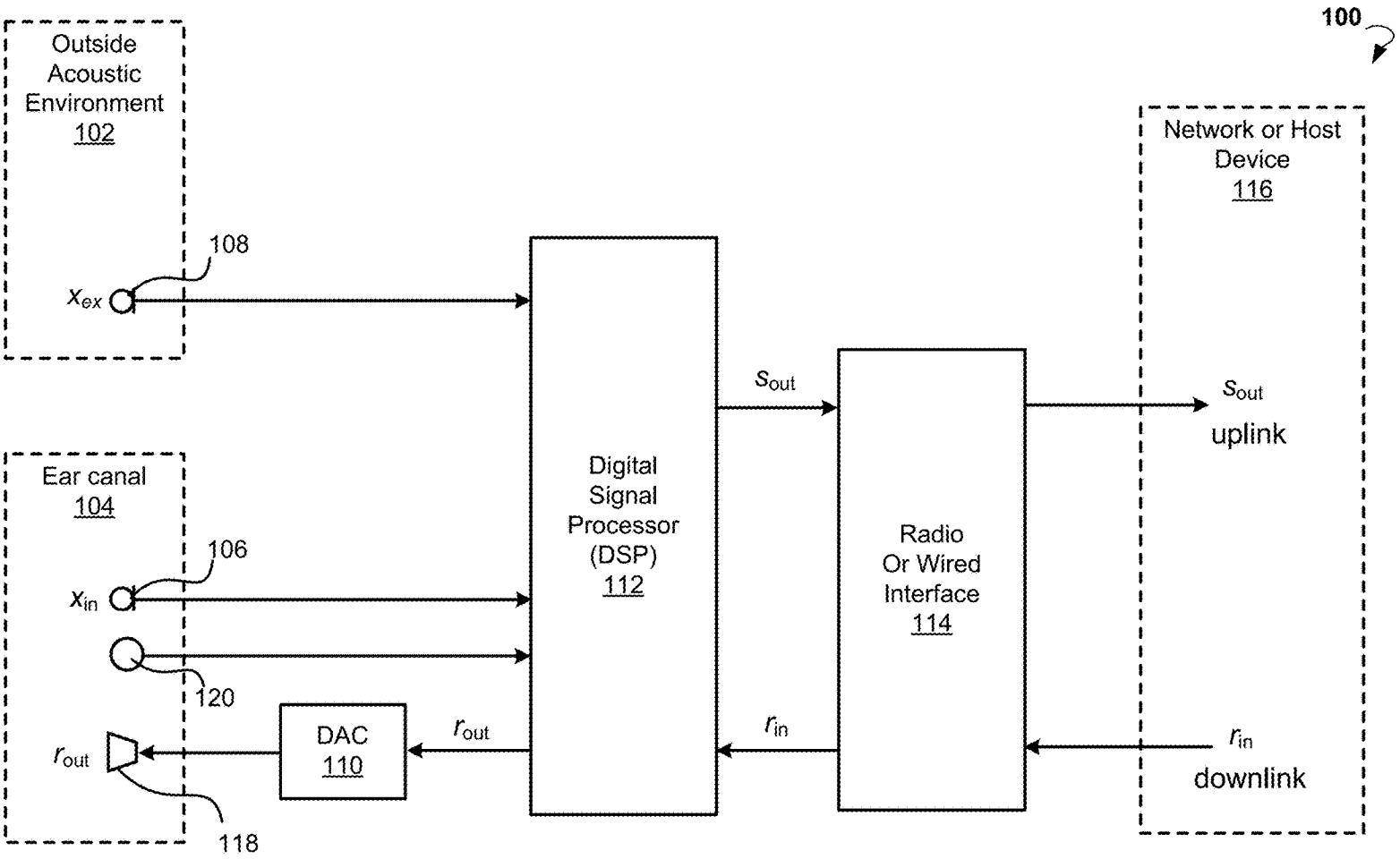
FIG. 1 is a block diagram of a system and an environment in which the system is used, according to an example embodiment.

Referring now to FIG. 1, a block diagram of an example system 100 suitable for performing occlusion reduction and ANR and an environment thereof are shown. The example system 100 includes at least an internal microphone 106, an external microphone 108, a digital signal processor (DSP) 112, and a wireless or wired interface 114. The internal microphone 106 is located inside a user's ear canal 104 and is relatively shielded from the outside acoustic environment 102. The external microphone 108 is located outside of the user's ear canal 104 and is exposed to the outside acoustic environment 102. In some embodiments, the example system 100 includes an accelerometer 120. The accelerometer 120 is located inside user's ear canal 104.

In various embodiments, the microphones 106 and 108 are either analog or digital. In either case, the outputs from the microphones are converted into synchronized pulse code modulation (PCM) format at a suitable sampling frequency and connected to the input port of the DSP 112. The signals $x_{in}$ and $x_{ex}$ denote signals representing sounds captured by internal microphone 106 and external microphone 108, respectively.

The DSP 112 performs appropriate signal processing tasks to improve the quality of microphone signals $x_{in}$ and $x_{ex}$, according to some embodiments. The output of DSP 112, referred to as the send-out signal ($s_{out}$), is transmitted to the desired destination, for example, to a network or host device 116 (see signal identified as $s_{out}$ uplink), through a radio or wired interface 114.

In certain embodiments, a signal is received by the network or host device 116 from a suitable source (e.g., via the wireless radio or wired interface 114). This is referred to as the receive-in signal ($r_{in}$) (identified as $r_{in}$ downlink at the network or host device 116). The receive-in signal can be coupled via the radio or wired interface 114 to the DSP 112 for processing. The resulting signal, referred to as the receive-out signal ($r_{out}$), is converted into an analog signal through a digital-to-analog convertor (DAC) 110 and then connected to a loudspeaker 118 in order to be presented to the user. In some embodiments, the loudspeaker 118 is located in the same ear canal 104 as the internal microphone 106. In other embodiments, the loudspeaker 118 is located in the ear canal opposite the ear canal 104. In the example of FIG. 1, the loudspeaker 118 is found in the same ear canal 104 as the internal microphone 106; therefore, an acoustic echo canceller (AEC) may be needed to prevent the feedback of the received signal to the other end. Optionally, if no further processing of the received signal is necessary, the receive-in signal ($r_{in}$) can be coupled to the loudspeaker 118 without going through the DSP 112. In some embodiments, the receive-in signal $r_{in}$ includes an audio content (for example, music) presented to the user.

Figure 2:
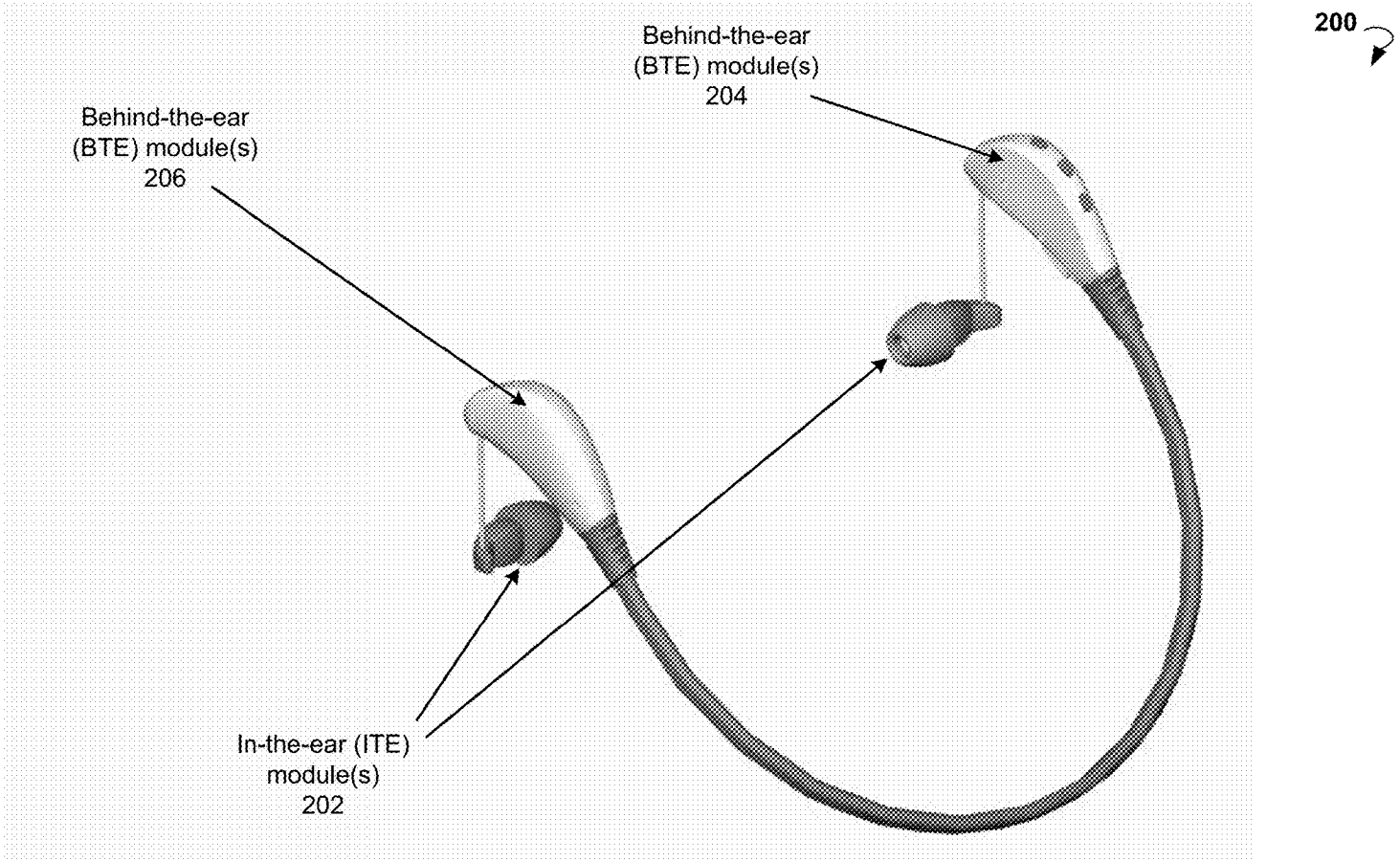
FIG. 2 is a block diagram of a headset suitable for implementing the present technology, according to an example embodiment.

FIG. 2 shows an example headset 200 suitable for implementing methods of the present disclosure. The headset 200 includes example in-the-ear (ITE) module(s) 202 and behind-the-ear (BTE) modules 204 and 206 for each ear of a user. The ITE module(s) 202 are configured to be inserted into the user's ear canals. The BTE modules 204 and 206 are configured to be placed behind (or otherwise near) the user's ears. In some embodiments, the headset 200 communicates with host devices through a wireless radio link. The wireless radio link may conform to a Bluetooth Low Energy (BLE), other Bluetooth, 802.11, or other suitable wireless standard and may be variously encrypted for privacy. The example headset 200 is a nonlimiting example, other variations having just an in-the-ear "earpiece" may be used to practice the present technology.

In various embodiments, ITE module(s) 202 include internal microphone 106 and the loudspeaker(s) 118 (shown in FIG. 1), all facing inward with respect to the ear canals. The ITE module(s) 202 can provide acoustic isolation between the ear canal(s) 104 and the outside acoustic environment 102. In some embodiments, ITE module(s) 202 includes at least one accelerometer 120 (also shown in FIG. 1).

In some embodiments, each of the BTE modules 204 and 206 includes at least one external microphone 108 (also shown in FIG. 1). The BTE module 204 may include a DSP 112 (as shown in FIG. 1), control button(s), and Bluetooth radio link to host devices. In certain embodiments, the BTE module 206 includes a suitable battery with charging circuitry.

The system and headset in FIGS. 1 and 2 is discussed in more detail in U.S. patent application Ser. No. 14/853,947, entitled "Microphone Signal Fusion," filed on Sep. 14, 2015, the disclosure of which is incorporated herein by reference for all purposes.

In certain embodiments, the seal of the ITE module(s) 202 is good enough to isolate acoustic waves coming from the outside acoustic environment 102. However, when speaking or singing, a user can hear the user's own voice reflected by ITE module(s) 202 back into the corresponding ear canal. The sound of the voice of the user is distorted since, while traveling through the user's skull, the high frequencies of the voice are substantially attenuated and thus has a much narrower effective bandwidth compared to voice conducted through air. As a result, the user can hear mostly the low frequencies of the voice.

Figure 3:
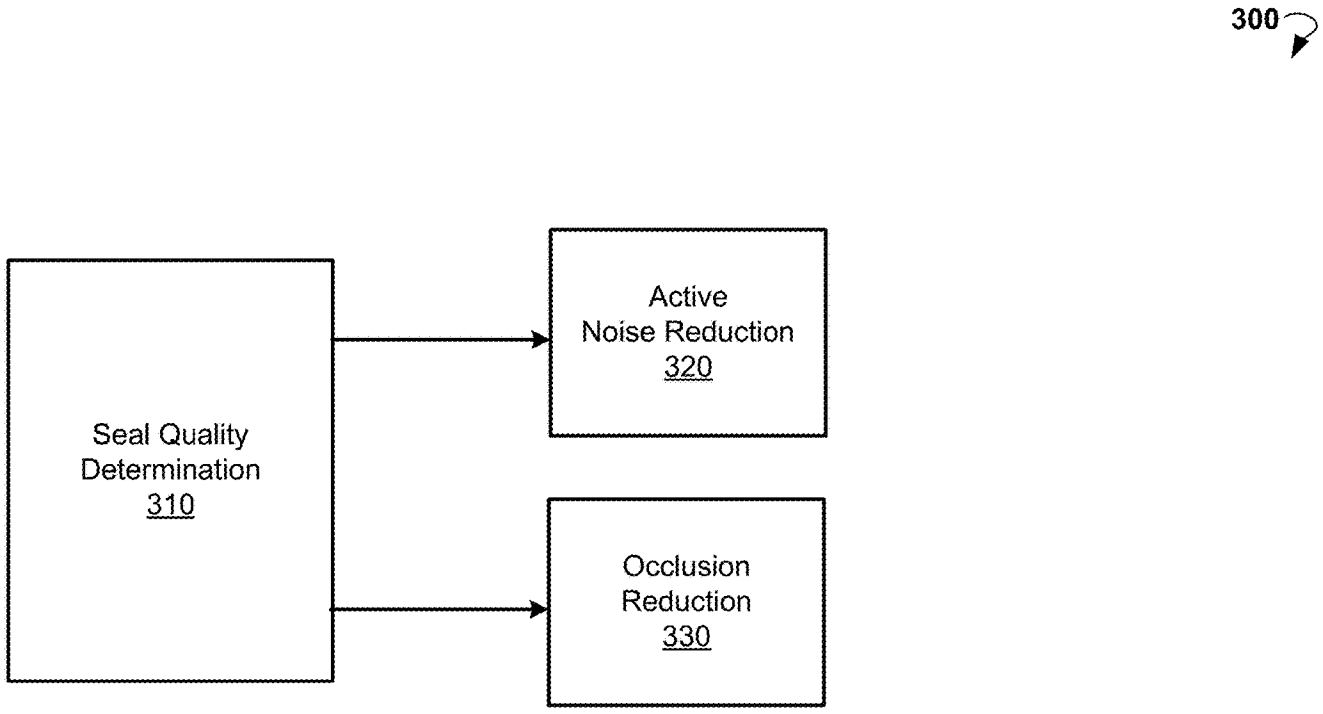
FIG. 3 is a block diagram illustrating a system for performing occlusion reduction and active noise reduction based on a determination of seal quality, according to an example embodiment.

FIG. 3 is a block diagram showing a system 300 for performing occlusion reduction and ANR based on a determination of a seal quality, according to an example embodiment. The example system 300 includes seal quality determination module 310, an active noise reduction (ANR) module 320, and an occlusion reduction module 330. The modules of system 300 can be implemented as instructions stored in a memory and executed by at least one processor, for example, DSP 112. In certain embodiments, at least some of the instructions performing the functionalities of the modules 310-330 are stored in a memory and executed by at least one processor of the network or host device 116.

In some embodiments, the occlusion reduction module 330 is operable to receive at least internal microphone signal $x_{in}$ and perform active occlusion reduction. The active occlusion reduction may be used to cancel some components of the distorted voice to restore a natural voice sound inside ear canal 104. The distorted voice is captured by the internal microphone inside the ear cancel. The active occlusion reduction generates, based on the internal microphone signal $x_{in}$, a first signal. When played by loudspeaker 118, the first signal cancels out some low frequencies (e.g., where the distortion due to the skull is found) of the distorted voice and by doing so improves voice quality distorted by travelling through the skull.

In other embodiments, the ANR module 320 is used to reduce outside unwanted noise (also referred to as background noise) captured by external microphone 108 from outside acoustic environment 102. ANR module 320 receives signal $x_{ex}$ captured by external microphone 108. ANR module 320 generates, based on the signal $x_{ex}$, a second signal. When played by the loudspeaker 118, the second signal cancels the outside unwanted noise within the ear canal 104.

In various embodiments, the occlusion reduction can be carried via use of a limited bandwidth noise cancellation since, while traveling through human tissue, the high frequencies of the user's voice are substantially attenuated and thus has a much narrower effective bandwidth compared to voice conducted through air. Thus, the bandwidth of noise cancellation for occlusion reduction may be limited to between 100 Hz and 1 KHz, for example.

In various embodiments, switching between the first operational mode for the occlusion reduction (e.g., using occlusion reduction module 330) and the second operational mode for the ANR (e.g., using the ANR module 320) is based on the determination of the quality of the seal of the ear canal. In various embodiments, the seal quality determination module 310 is operable to determine the quality of the seal by comparing signal $x_{ex}$ captured by the external microphone 108 and signal $x_{in}$ captured by internal microphone 106. If signal $x_{in}$ includes noise components similar to the noise components of signal $x_{ex}$, it indicates that outside noise is heard inside the earbud, reflective of a bad seal quality, according to various embodiments. The quality of the ear seal might be determined by any of a variety of suitable methods/including comparing the internal and external mic, but is not limited to that method. An example system suitable for determining seal quality is discussed in more detail in U.S. patent application Ser. No. 14/985,187, entitled "Audio Monitoring and Adaptation Using Headset Microphones Inside of User's Ear Canal," filed on Dec. 30, 2015, the disclosure of which is incorporated herein by reference for all purposes.

In various embodiments, when the ANR is performed in response to the determination that the seal of the ear canal is poor, accelerometer data from accelerometer 120 located inside the ITE module(s) 202 can be used to discriminate between the voice of the user and background noise in the external microphone signal $x_{ex}$. For example, the accelerometer may be used to detect signals (e.g., motion of the user's head) that are indicative of the user speaking. In various embodiments, if it is determined that the user is speaking then the ANR module 320 reduces noise in a way that reduces or cancels the background noise without suppressing the voice components of the user's voice in a way that would distort it. That is, the background noise in the received acoustic signal is suppressed, in various embodiments, in a way that does not result in also causing distortion of the part of acoustic signal that represents the users's voice. An example audio processing system suitable for performing this balance between noise cancellation and voice quality is discussed in more detail in U.S. patent application Ser. No. 12/832,901 (now U.S. Pat. No. 8,473,287), entitled "Method for Jointly Optimizing Noise Reduction and Voice Quality in a Mono or Multi-Microphone System," filed on Jul. 8, 2010, the disclosure of which is incorporated herein by reference for all purposes.

Although separate modules are shown in FIG. 3 for ANR and occlusion reduction, the ANR module 320 may be configured to perform ANR and the noise cancellation for the occlusion reduction.

In certain embodiments, the ITE module(s) 202 may include a mechanical vent. The mechanical vent may include an electroactive polymer. The mechanical vent may be configured to be closed to make a better seal. In response to the determination that a seal of the ear is good (e.g., the quality of the seal is above a predetermined threshold) and the voice of the user sounds distorted inside the ear canal, the mechanical vent may be opened to let the user's voice that is inside the ear canal 104 travel outside the ITE module(s) 202. When the mechanical vent is open, the distorted user's voice may bounce back less to the ear canal so as to reduce the uncomfortable sound presented to the user. At the same time, opening of the mechanical vent would let in the outside acoustic signals which may not only let in the undistorted user's voice from outside, but also let in background noise inside the ear canal. Active noise cancellation may be performed to cancel just this background noise so that the opening of the mechanical vent does not cause additional outside background noise to be heard by the user. By way of example and not limitation, the mechanical vent may be activated when the user starts a phone call. In certain embodiments, the mechanical vent is activated when the seal quality is above a threshold and speech (for example, from speakers other than the user) is detected, while an external noise is present and the user is listening to music without talking or singing along. The mechanical vent may also actively relieve air pressure in the ear to provide greater comfort for the user.

An example audio processing system suitable for performing noise cancellation and/or noise reduction is discussed in more detail in U.S. patent application Ser. No. 12/832,901 (now U.S. Pat. No. 8,473,287), entitled "Method for Jointly Optimizing Noise Reduction and Voice Quality in a Mono or Multi-Microphone System," filed on Jul. 8, 2010, the disclosure of which is incorporated herein by reference for all purposes. By way of example and not limitation, noise reduction methods are described in U.S. patent application Ser. No. 12/215,980 (now U.S. Pat. No. 9,185,487), entitled "System and Method for Providing Noise Suppression Utilizing Null Processing Noise Subtraction," filed Jun. 30, 2008, and in U.S. patent application Ser. No. 11/699,732 (now U.S. Pat. No. 8,194,880), entitled "System and Method for Utilizing Omni-Directional Microphones for Speech Enhancement," filed Jan. 29, 2007, which are incorporated herein by reference in their entireties.

Figure 4:
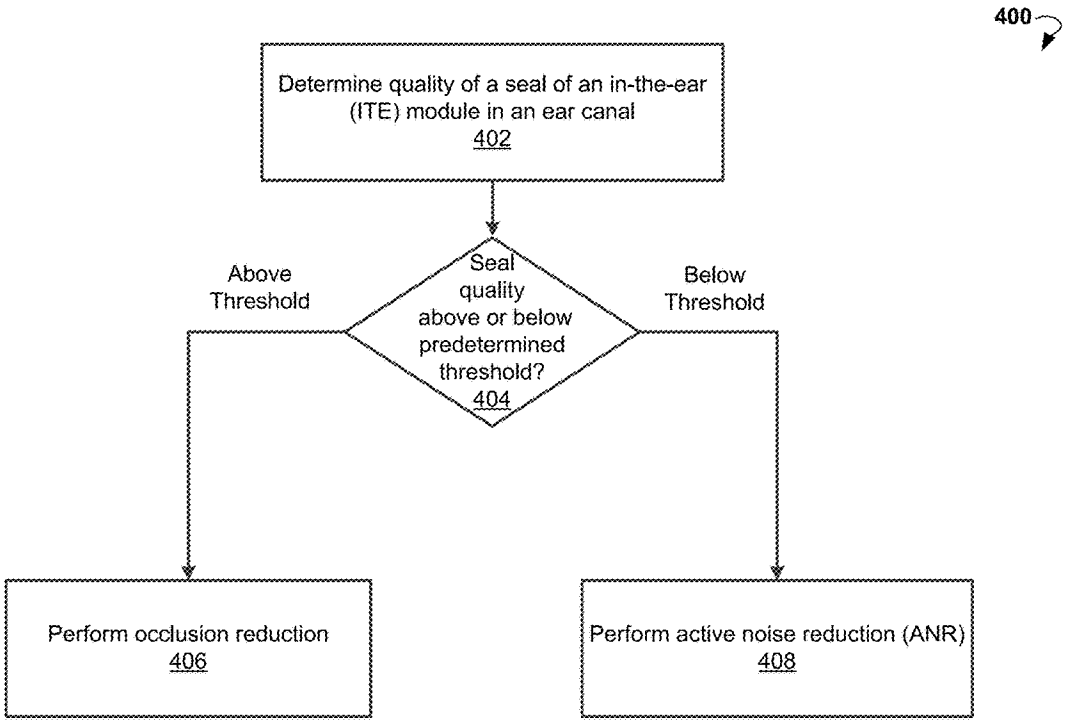
FIG. 4 is a flow chart showing steps of a method for performing either occlusion reduction or active noise reduction based on a determination of seal quality, according to an example embodiment.

FIG. 4 is a flow chart showing steps of method 400 for performing either occlusion reduction or ANR based on a determination of a seal quality, according to various example embodiments. The example method 400 can commence with determining a quality of the seal of a user's ear canal that is provided by an in-the-ear (ITE) module inserted therein, in block 402. In some embodiments, the quality of the seal can be determined based on a difference of signal $x_{ex}$ captured by the external microphone 108 and signal $x_{in}$ captured by the internal microphone 106. If signal $x_{in}$ includes components similar to components of signal $x_{ex}$, it indicates that outside noise is captured by the internal microphone (e.g., in the ITE module) inside the ear canal.

In decision block 404, a decision is made based on the quality of the seal of the ear canal. If the quality of the seal is above a predetermined threshold value, method 400, in this example, proceeds with performing occlusion reduction in block 406. Alternatively, if the quality of the seal is below a predetermined threshold value, then method 400, in this example, performs ANR in block 408. The predetermined threshold value may be determined based on, for example, the difference in signal between the signal $x_{ex}$ captured by the external microphone 108 and signal $x_{in}$ captured by internal microphone 106 being over a certain threshold, indicating the seal is such that outside noise that the external microphone 108 captures is not being captured by the internal microphone 106 because of the seal. In some embodiments, the predetermined threshold value may be a table of values or other relationship, such that there is continually varying, e.g., including a mix of occlusion reduction and ANR for certain values, rather than just switching between occlusion reduction and ANR.

Figure 5:
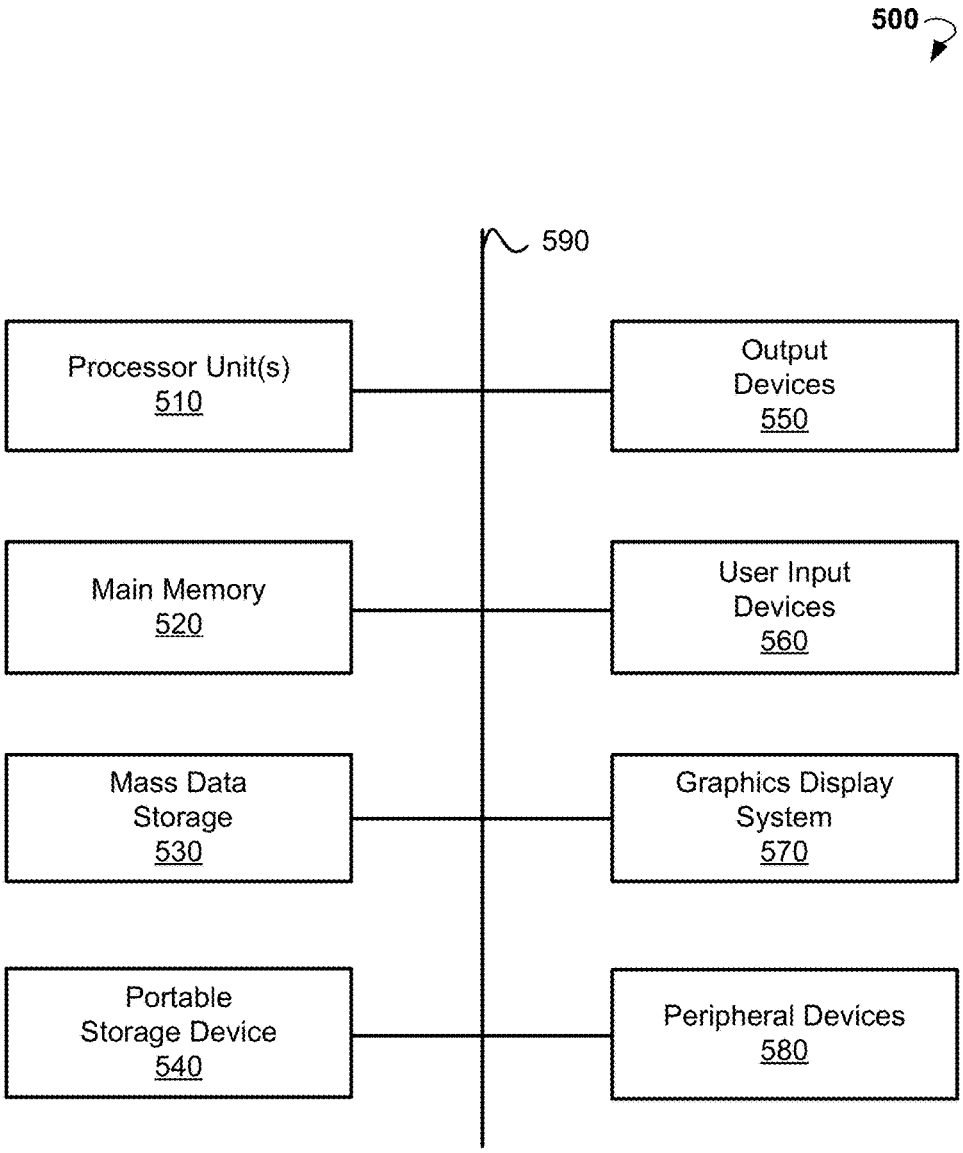
FIG. 5 illustrates an example of a computer system that may be used to implement embodiments of the disclosed technology.

FIG. 5 illustrates an exemplary computer system 500 that may be used to implement some embodiments of the present invention. The computer system 500 of FIG. 5 may be implemented in the contexts of the likes of computing systems, networks, servers, or combinations thereof. The computer system 500 of FIG. 5 includes one or instructions and data for execution by processor unit(s) 510. Main memory 520 stores the executable code when in operation, in this example. The computer system 500 of FIG. 5 further includes a mass data storage 530, portable storage device 540, output devices 550, user input devices 560, a graphics display system 570, and peripheral devices 580.

The components shown in FIG. 5 are depicted as being connected via a single bus 590. The components may be connected through one or more data transport means. Processor unit(s) 510 and main memory 520 are connected via a local microprocessor bus, and the mass data storage 530, peripheral device(s) 580, portable storage device 540, and graphics display system 570 are connected via one or more input/output (I/O) buses.

Mass data storage 530, which can be implemented with a magnetic disk drive, solid state drive, or an optical disk drive, is a non-volatile storage device for storing data and instructions for use by processor unit(s) 510. Mass data storage 530 stores the system software for implementing embodiments of the present disclosure for purposes of loading that software into main memory 520.

Portable storage device 540 operates in conjunction with a portable non-volatile storage medium, such as a flash drive, floppy disk, compact disk, digital video disc, or Universal Serial Bus (USB) storage device, to input and output data and code to and from the computer system 500 of FIG. 5. The system software for implementing embodiments of the present disclosure is stored on such a portable medium and input to the computer system 500 via the portable storage device 540.

User input devices 560 can provide a portion of a user interface. User input devices 560 may include one or more microphones, an alphanumeric keypad, such as a keyboard, for inputting alphanumeric and other information, or a pointing device, such as a mouse, a trackball, stylus, or cursor direction keys. User input devices 560 can also include a touchscreen. Additionally, the computer system 500 as shown in FIG. 5 includes output devices 550. Suitable output devices 550 include speakers, printers, network interfaces, and monitors.

Graphics display system 570 includes a liquid crystal display (LCD) or other suitable display device. Graphics display system 570 is configurable to receive textual and graphical information and processes the information for output to the display device.

Peripheral devices 580 may include any type of computer support device to add additional functionality to the computer system.

The components provided in the computer system 500 of FIG. 5 are those typically found in computer systems that may be suitable for use with embodiments of the present disclosure and are intended to represent a broad category of such computer components that are well known in the art. Thus, the computer system 500 of FIG. 5 can be a personal computer (PC), hand held computer system, telephone, mobile computer system, workstation, tablet, phablet, mobile phone, server, minicomputer, mainframe computer, wearable, or any other computer system. The computer may also include different bus configurations, networked platforms, multi-processor platforms, and the like. Various operating systems may be used including UNIX, LINUX, WINDOWS, MAC OS, PALM OS, QNX ANDROID, IOS, CHROME, TIZEN, and other suitable operating systems.

The processing for various embodiments may be implemented in software that is cloud-based. In some embodiments, the computer system 500 is implemented as a cloud-based computing environment, such as a virtual machine operating within a computing cloud. In other embodiments, the computer system 500 may itself include a cloud-based computing environment, where the functionalities of the computer system 500 are executed in a distributed fashion. Thus, the computer system 500, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices. Systems that provide cloud-based resources may be utilized exclusively by their owners or such systems may be accessible to outside users who deploy applications within the computing infrastructure to obtain the benefit of large computational or storage resources.

The cloud may be formed, for example, by a network of web servers that comprise a plurality of computing devices, such as the computer system 500, with each server (or at least a plurality thereof) providing processor and/or storage resources. These servers may manage workloads provided by multiple users (e.g., cloud resource customers or other users). Typically, each user places workload demands upon the cloud that vary in real-time, sometimes dramatically. The nature and extent of these variations typically depends on the type of business associated with the user.

The present technology is described above with reference to example embodiments. Therefore, other variations upon the example embodiments are intended to be covered by the present disclosure.

What is claimed is:

1. A method for audio processing, the method comprising:

receiving acoustic signals, each of the acoustic signals representing at least one captured sound having a voice component and an unwanted noise;

determining, based at least partially on the acoustic signals, a quality of a seal, provided by an in-the-ear module of a headset, of an ear canal of a user;

checking the determined quality of the seal against a predetermined threshold value, and based on the checking:

if the quality of the seal is above the predetermined threshold value, performing an occlusion reduction on the acoustic signals to improve the voice component; and if the quality of the seal is below the predetermined threshold value, performing an active noise reduction (ANR) on the acoustic signals to reduce the unwanted noise.

2. The method of claim 1, wherein the voice component includes the voice of the user.

3. The method of claim 1, wherein:

the acoustic signals include a first acoustic signal captured outside the ear canal and a second acoustic signal captured inside the ear canal; and the determination of the quality of the seal includes comparing the first acoustic signal and the second acoustic signal.

4. The method of claim 1, wherein the occlusion reduction includes performing active noise cancellation for a limited bandwidth of the acoustic signals.

5. The method of claim 4, wherein the limited bandwidth is within a frequency range between 100 Hz and 1 kHz.

6. The method of claim 1, wherein the predetermined threshold value is a table of values such that occlusion reduction and the ANR are performed on a continually varying basis as a function of the predetermine threshold value.

7. The method of claim 6, further comprising:

determining whether the voice component has qualities indicative of the quality of the seal being above the predetermined threshold value, wherein the in-the-ear module operates in a first mode in response to the determining indicating that the voice component has qualities indicative of the quality of the seal being above the predetermined threshold value.

8. The method of claim 1, wherein the ANR includes:

discriminating between the voice component and the unwanted noise; and cancelling, based on results of the discrimination, the unwanted noise in the acoustic signals.

9. The method of claim 8, wherein the discrimination is based on data from an accelerometer located inside the ear canal, the accelerometer providing one or more signals indicative of the user speaking.

10. The method of claim 9, wherein, while detecting that the user is speaking, the ANR is configured to limit distortion of the voice components that represents the user's voice while performing the ANR on the acoustic signals.

11. The method of claim 1, wherein the occlusion reduction includes:

activating a mechanical vent to allow sound waves from outside of the ear canal to penetrate inside the ear canal, the mechanical vent being activated in response to the checking indicating that the quality of the seal is above the predetermined threshold value; and cancelling noise in the sound waves.

12. A system for audio processing, the system comprising:

at least one processor to receive acoustic signals, each acoustic signal representing at least one captured sound having a voice component and an unwanted noise;

at least one processor to determine, based at least partially on the acoustic signals, a quality of a seal, provided by an in-the-ear module of a headset, of an ear canal of a user;

at least one processor to check the determined quality of the seal against a predetermined threshold value, and based on the checking:

if the quality of the seal is above the predetermined threshold value, at least one processor being configured to perform an occlusion reduction on the acoustic signals to improve the voice component; and if the quality of the seal is below the predetermined threshold value, at least one processor being configured to perform an active noise reduction (ANR) on the acoustic signals to reduce the unwanted noise.

13. The system of claim 12, wherein the voice component includes the voice of the user.

14. The system of claim 12, wherein:

the acoustic signals include a first acoustic signal captured outside the ear canal and a second acoustic signal captured inside the ear canal; and the quality of the seal is determined by comparing the first acoustic signal and the second acoustic signal.

15. The system of claim 12, wherein the occlusion reduction includes performing an active noise cancellation for a limited bandwidth of the acoustic signals, the limited bandwidth being within a frequency range between 100 Hz and 1 kHz.

16. The system of claim 12, wherein the occlusion reduction and the ANR are performed by a module configured to operate, based on the determination of the quality of the seal, in a first mode for performing the occlusion reduction and a second mode for performing the ANR.

17. The system of claim 16, further comprising:

at least one processor configured to determine whether the voice component has distortion indicative of the quality of the seal being above the predetermined threshold, wherein the module operates in the first mode in response to the at least one processor configured to determine whether the voice component has distortion indicative of the quality of the seal being above the predetermined threshold indicates that the voice component has distortion indicative of the quality of the seal being above the predetermined threshold.

18. The system of claim 12, wherein the ANR includes:

discriminating between the voice component and the unwanted noise; and cancelling, based on results of the discriminating, the unwanted noise in the acoustic signals.

19. The system of claim 18, wherein the discriminating is based on data from an accelerometer located inside the ear canal, the accelerometer detecting at least motion indicative of the user speaking.

20. The system of claim 12, wherein the occlusion reduction includes:

activating a mechanical vent to allow sound waves from outside of the ear canal to penetrate inside the ear canal, the mechanical vent being activated in response to the checking indicating that the quality of the seal is above the predetermined threshold; and cancelling noise in the sound waves.

21. A non-transitory computer-readable storage medium having embodied thereon instructions, which, when executed by at least one processor, cause the at least one processor to perform steps of a method, the method comprising:

receiving acoustic signals, each of the acoustic signals representing at least one captured sound having a voice component and an unwanted noise;

determining, based at least partially on the acoustic signals, a quality of a seal, provided by an in-the-ear module of a headset, of a user's ear canal;

checking the determined quality of the seal against a predetermined threshold value, and based on the checking:

if the quality of the seal is above the predetermined threshold value, performing an occlusion reduction on the acoustic signals to improve the voice component; and if the quality of the seal is below the predetermined threshold value, performing an active noise reduction (ANR) on the acoustic signals to reduce the unwanted noise.

* * * * *